US006412782B1

(12) United States Patent
Rivet et al.

(10) Patent No.: US 6,412,782 B1
(45) Date of Patent: Jul. 2, 2002

(54) CONTINUOUS WATER DAM GATE DEVICE

(76) Inventors: Robert R. Rivet, 315 Credit Creek Blvd., Orangeville Ontario (CA), L9W 4M9; Francis S. Rivet, 2267 Lakeshore Blvd. W., Etobicoke Ontario (CA), M8V 3X2

( * ) Notice: Subject to any disclaimer, the term of this patent is extended or adjusted under 35 U.S.C. 154(b) by 0 days.

(21) Appl. No.: 09/580,951

(22) Filed: May 30, 2000

Related U.S. Application Data

(63) Continuation-in-part of application No. 09/495,864, filed on Feb. 2, 2000, now Pat. No. 6,250,636.

(51) Int. Cl.[7] ..... A63F 9/00
(52) U.S. Cl. ..... 273/457; 273/459
(58) Field of Search ..... 273/445, 446, 273/457, 440, 459, 460; 446/267; 222/481, 478, 566; 239/375, 533.1, 533.15

(56) References Cited

U.S. PATENT DOCUMENTS

| | | | | |
|---|---|---|---|---|
| 4,118,027 A | | 10/1978 | Cody | |
| 4,243,220 A | | 1/1981 | Shelley | |
| 4,348,028 A | | 9/1982 | Barlow | |
| 4,826,161 A | | 5/1989 | Rookmaaker | |
| 4,890,838 A | | 1/1990 | Rudell | |
| 5,062,550 A | * | 11/1991 | Singh | 222/80 |
| 5,632,490 A | | 5/1997 | Brown | |
| 5,839,964 A | * | 11/1998 | Rudell et al. | 472/117 |
| 6,047,866 A | * | 4/2000 | Brown | 222/608 |
| 6,250,636 B1 | * | 6/2001 | Rivet et al. | 273/457 |

* cited by examiner

*Primary Examiner*—Raleigh W. Chiu
(74) *Attorney, Agent, or Firm*—Riches, McKenzie & Herbert LLP

(57) ABSTRACT

A game device with a water reservoir having a plurality of openings for exit of water from the reservoir and blocking members adapted to either block the flow of water from the openings or permit the flow of water from the openings.

19 Claims, 8 Drawing Sheets

CONTINUOUS WATER DAM GATE DEVICE

This application is a continuation-in-part of U.S. patent application Ser. No. 09/495,864 filed on Feb. 2, 2000, now U.S. Pat. No. 6,250,636.

SCOPE OF THE INVENTION

This invention relates to a water game device and, more particularly, to a game device in which contestants block or unblock the flow of water and their relative success is measured by the flow of water.

BACKGROUND OF THE INVENTION

The present inventor has appreciated that while children and adults are fascinated by the flow of water that games and, particularly, competitive games typically do not utilize a player's ability to control the flow of water in a game device.

Previously known game devices frequently do not place the game players under time pressures to perform and, particularly, under time pressures which are variable depending upon the play and are not merely directed to a counting of time.

SUMMARY OF THE INVENTION

To at least partially overcome these disadvantages of previously known devices, the present invention provides a game device with a water reservoir having a plurality of openings for exit of water from the reservoir and blocking members adapted to either block the flow of water from the openings or permit the flow of water from the openings.

An object of the present invention is to provide a game device in which players either block the flow of water from a reservoir or permit flow of water from the reservoir.

Another object is to provide a game device in which selective flow of water from a reservoir determines the relative success of the players.

Another object is to provide a game device in which players block or facilitate water flow between vessels.

Another object is to provide a method of operating a game device in which the selective damming and/or flow of water controls the relative success.

Another object is to provide a same device with controlled flow of water.

Accordingly, in one aspect, the present invention provides a game device comprising:

a water reservoir, a plurality of openings for exit of water from the reservoir, each opening having at least one blocking member adapted to either block flow of water from the opening or permit flow of water from the openings.

In another aspect the present invention provides a game device comprising:

a water reservoir, at least one spillway for flow of water from the reservoir, blocking members to block the flow of water into, through or out of the spillway, the blocking members removably secured to the device wherein when secured to the device a blocking member is adapted to at least partially restrict flow of water through the spillway and when removed does not restrict flow of water through the spillway.

In a further aspect, the present invention provides a game device comprising:

a water reservoir, at least one water collection receptacle, at least one spillway for flow of water from the reservoir to each receptacle, at least one removable blocking member to block the flow of water through each spillway, the blocking member removably secured to the device wherein when secured to the device the blocking member at least partially restricts flow of water through the spillway and when removed does not restrict flow of water through the spillway.

In another aspect, the present invention provides a method of playing a water dam game with a game device comprising a chance determining mechanism activatable to select one of a number of possible outcomes, a plurality of openings for exit of water from the reservoir, and a plurality of blocking members, each blocking member adapted to be movable between positions in which it either blocks flow of water from at least one opening or permits flow of water from the reservoir through at least one opening, the method involving successive player turns of activating the chance mechanism and moving one or more blocking members between positions in which the blocking members either block flow of water or permit flow of water at least partially dependent by the outcome of the chance mechanism.

DETAILED DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
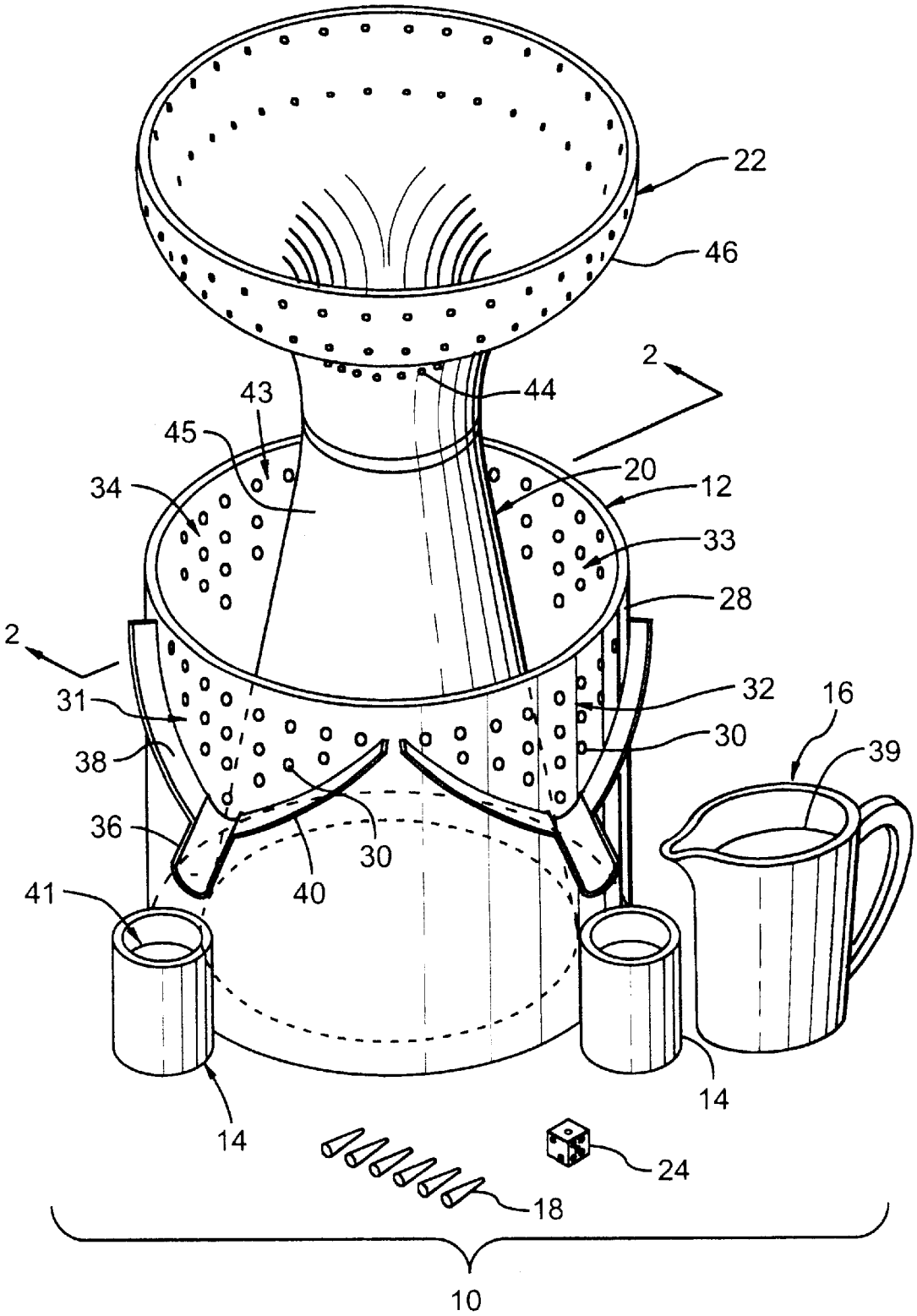
FIG. 1 is a schematic pictorial view of a game device in accordance with a first embodiment of the invention.

Reference is made first to FIG. 1 which shows a partially exploded view of the various components of a game device 10 in accordance with a first embodiment of the present invention. The components include a reservoir 12, collection receptacles 14, measuring cup 16, blocking pegs 18, internal displacement member 20, delay vessel 22 and dice 24.

Figure 2:
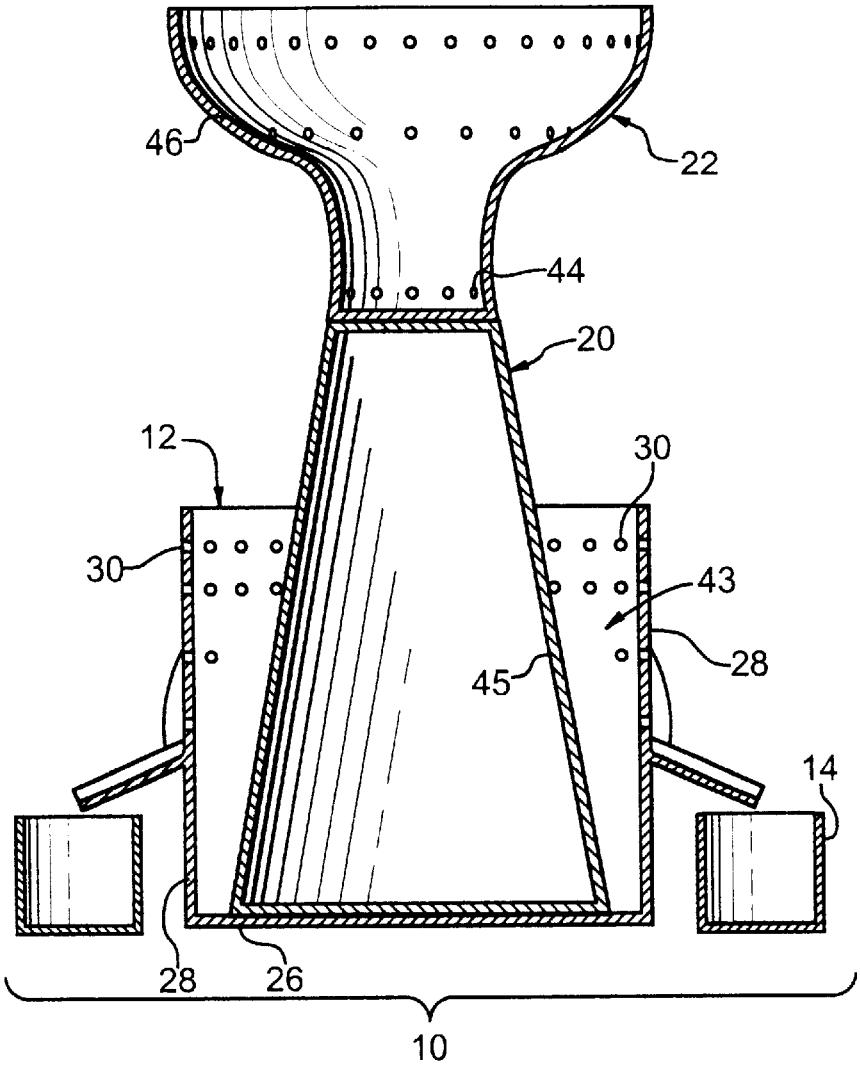
FIG. 2 is a cross-sectional side view of the game device of FIG. 1 along line 2—2' in FIG. 1 showing the elements in their relative positions for one arrangement for use.

As seen in FIGS. 1 and 2, reservoir 12 has a base 26 and upstanding side walls 28 which effectively form a water retaining receptacle. The side walls have a plurality of openings 30 therethrough. The openings are shown as arranged into four different arrays 31, 32, 33 and 34, each located on a respective separate segment of the side walls spaced about the perimeter of the bottom wall from the other arrays. In the preferred embodiment, each of the openings 30 is shown as being of identical size and cross-section. As well, the openings 30 of each of the arrays correspond to the openings in the other arrays. In this regard, the openings of each array correspond not only in number, size and elevation but also, preferably, in relative location. Each array shown appears as a generally inverted triangle. Elevation is referred to as the relative height above a horizontal plane, for example, the base 26.

A collection receptacle 14 is associated with each array of openings. The collection receptacle 14 is to collect all the water which may flow out of the reservoir through the openings of the respective array. (To assist in ensuring that water flowing out the openings 30 of an array may be directed into the respective collection receptacle 14, preferably, a funnel device is provided having two side members 38 and 40 which direct water which may exit from the openings 30 to a central spout 36 which directs the water radially outwardly to a point where it may drop down into the receptacle 14.

FIG. 1 shows a plurality of pegs 18 which are shown as slightly frustoconical in configuration and size so as to be inserted into one of the openings 30 and be received within the openings 30 in a removable friction fit arrangement to block flow of water through the opening 30. The pegs 18 are adapted for easy manual insertion into the openings 30 and manual removal therefrom. While only six pegs 18 are shown, one peg 18 is to be provided for each opening 30.

The dice 24 shown in FIG. 1 is a conventional six-sided dice with dots for each of numbers 1 to 6 on one of its faces. The game device shown is adapted for use with four players, one player corresponding to each of the four arrays. Each player has a number of blocking pegs 18 corresponding to the number of openings 30 in his array. A first player commences play by filling the measuring cup 16 to a preset level as, for example, indicated by a level marking line 39 in the cup with water. Next, that player rolls the dice. If the dice is 1, 2 or 3, the player dumps the water from the cup into the reservoir 12. If the dice is 4, 5 or 6, the player does not dump the water from the cup into the reservoir. Next, the same player rolls the dice. The player is permitted to place a number of plugs into the openings 30 in his array corresponding to the number on the dice. The next player then repeats the same sequence. The players continue having successive turns. A player is disqualified from further play if the water which flows out the openings 30 in his respective array fills his collection receptacle 14 up to a certain predetermined level as, for example, indicated by a level marker 41 in the collection receptacle 14. At that point, the disqualified player fills the rest of his openings 30 with pegs. Play continues with the winning player being the last player who remains not disqualified or the first player to complete filling all their openings 30 with pegs.

The game can also be played in a different manner in which play is commenced with all the openings blocked by the pegs and the reservoir filled with water to a desired level. Play proceeds with the roll of the dice determining the number of pegs 18 which can be removed and the winner being either the first person to fill his collection receptacle 14 or the last person to fill it.

Reference is now made to FIG. 2 which best shows the internal displacement member 20 and the delay vessel 22. The internal displacement member 20 is shown in FIG. 2 as a generally frustoconical tower member which is adapted to be placed in the reservoir 12 and serves to reduce the volume of water which can be accepted by the reservoir 12 to a volume defined within an annular space 43 between the side walls 28 of the reservoir 12 and the interior walls 45 of the displacement member 20. The displacement member 20 could, for example, be arranged to be heavier than water so as not to float upwardly from the base 26 of the reservoir. The displacement member 20 could be provided to be received in a sealed snap-fit on the base. Alternatively, the displacement member could be provided as an integral part of the base 26. One purpose of the displacement member 20 is to reduce the amount of water necessary to raise the elevation of the water within the reservoir 12.

Another purpose of the interior displacement member 20 is to provide a support for the delay vessel 22. The delay vessel 22 is shown in FIG. 1 as an open topped bowl-like vessel with a plurality of holes 44 in its walls 46. The holes 44 are selected such that when water is poured into the delay vessel 22, the flow of water out of the holes 44 diffuses the flow of water downwardly to be even about the reservoir 12 and, thus, avoids uneven water elevations within the reservoir 12 caused, for example, by pouring water into the reservoir 12 from a measuring cup 16 aggressively towards some of the openings 30. As well, the holes 44 can be sized so as to provide a delay in the time that water poured into the delay vessel 22 may reach the reservoir 12. For example, a game could be started by a large volume of water, say, for example, a number of times the volume of the measuring cup 16 being placed into the delay vessel 22 with the holes 44 to delay the time within which the water from the delay vessel flows into the reservoir 12. The holes 44 in the delay vessel may merely be a single row or could comprise a plurality of rows as shown in FIG. 1 at different elevations with more or less openings in each successive row of openings. When the game device is used with the delay vessel 22, preferably, during play, the measuring cups of water are poured into the delay vessel 22, however, play could be carried out under a method whereby depending upon the roll of the dice, when water is to be added, it may be added either via the delay vessel 22 or directly into the reservoir 12. The delay vessel 22 may be provided of a size to provide all water that is necessary to reasonably play a game. A mechanism can be provided so as to close and open some of the holes 44 in the delay vessel 22. For example, a rotatable plate could be provided inside the delay vessel 22 which can be rotated to one position to close all the holes 44 and which, when rotated to another position, provides holes in the plate in registry with the holes 44. Alternatively, some or all of the holes 44 could be closed by pegs 18. For example, at the start of the game, the delay vessel 22 could be filled with a predetermined amount of water and that, at the commencement of the game, all the holes 44 could be opened.

Figure 3:
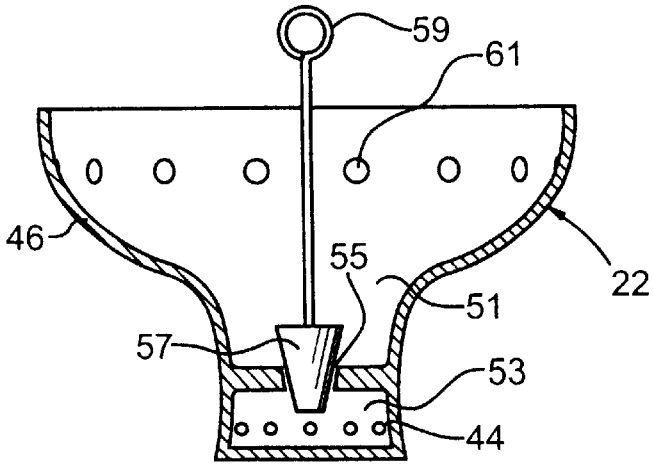
FIG. 3 is a cross-sectional side view of an alternate delay vessel to that shown in FIG. 2.

FIG. 3 shows a different arrangement of the delay vessel 22 with an upper compartment 51 and a lower compartment 53. A passageway 55 therebetween is shown closed by a stopper 57 which can manually be removed by its handle 59 to permit water to flow out the lower ring of holes 44. Vessel 22 may be filled with water and the stopper pulled, for example, at the start of or during the game. Holes shown in dashed lines as 61 could be provided in the upper compartment 51 to permit flow from these holes when water reaches their elevation yet with the stopper 57 providing for a rush of water when removed. The game could be played with the delay vessel 22 only being permitted to have its water flow down into the reservoir at the happening of certain events such as, for example, on rolling a specific roll of the dice. To vary the play of the game, at different times and on different sequences, the measuring cup 16 and/or the delay vessel 22 could be filled to different levels and the plunger be removed and/or inserted. Thus, the speed with which players would need to react could be varied dependent upon the skill level of the players or their age. Each player could be provided with a separate measuring cup 16 and, preferably, a water source such as a large pitcher of water could be provided for filling of the measuring cup 16, reservoir 12 and vessel 22 during play.

Figure 7:
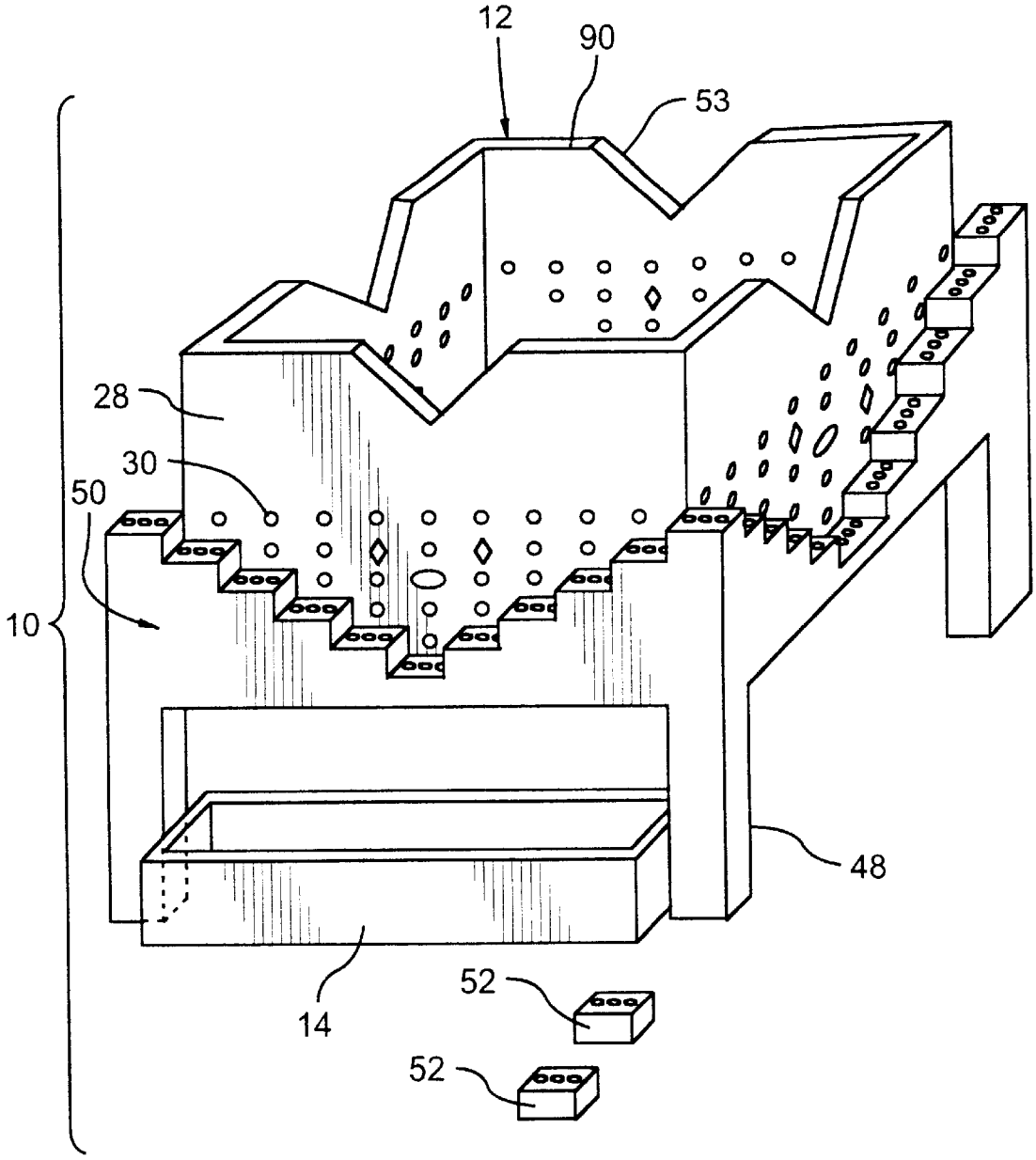
FIG. 7 is a pictorial view of a third embodiment of a game device in accordance with the present invention.

The preferred embodiment shows a funneling device being provided for each array. Filing device 36 is unnecessary and it would be possible, for example, to merely provide a collection receptacle 14 located in a manner below the openings of the array so that all water flowing downwardly from the openings would be collected by the receptacle. For example, in the context of a device as shown in FIG. 7, the receptacle 14 may be able to fit underneath the side wall of the receptacle substantially along the entire length of the receptacle and thereby possibly avoid the need for the funnel device.

Figure 4:
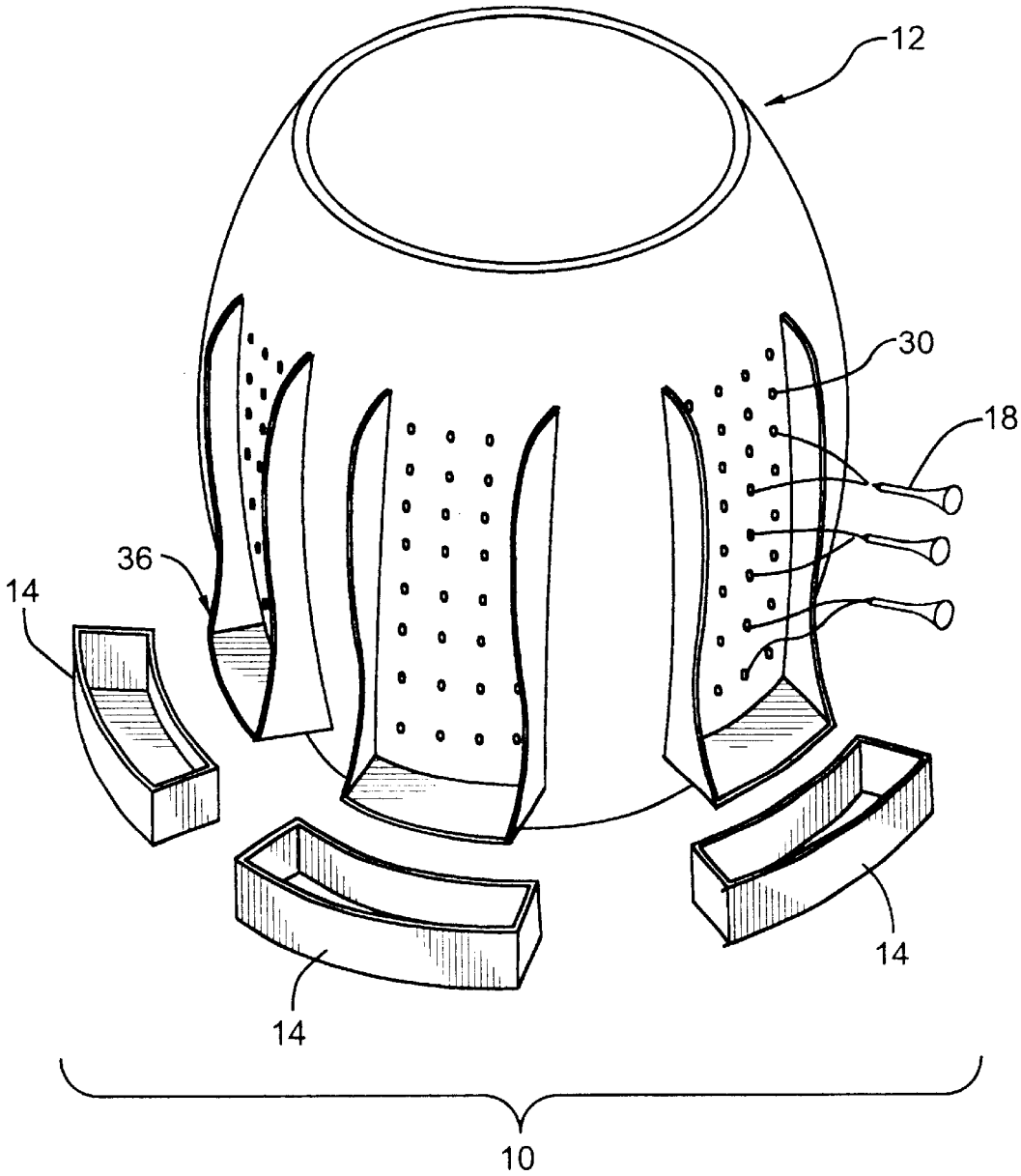
FIG. 4 is a pictorial view of a second embodiment of a game device in accordance with the present invention.

Reference is now made to FIG. 4 which shows a second embodiment of a game device in accordance with the present invention. In FIG. 4 and all the other figures, the same reference numerals are used to indicate the same elements as in FIGS. 1 to 3.

As seen in FIG. 4, the reservoir 12 is barrel-like and adapted to have six array of openings 30, each with a funneling device 36 to direct water into respective collection receptacles 14.

Figure 5:
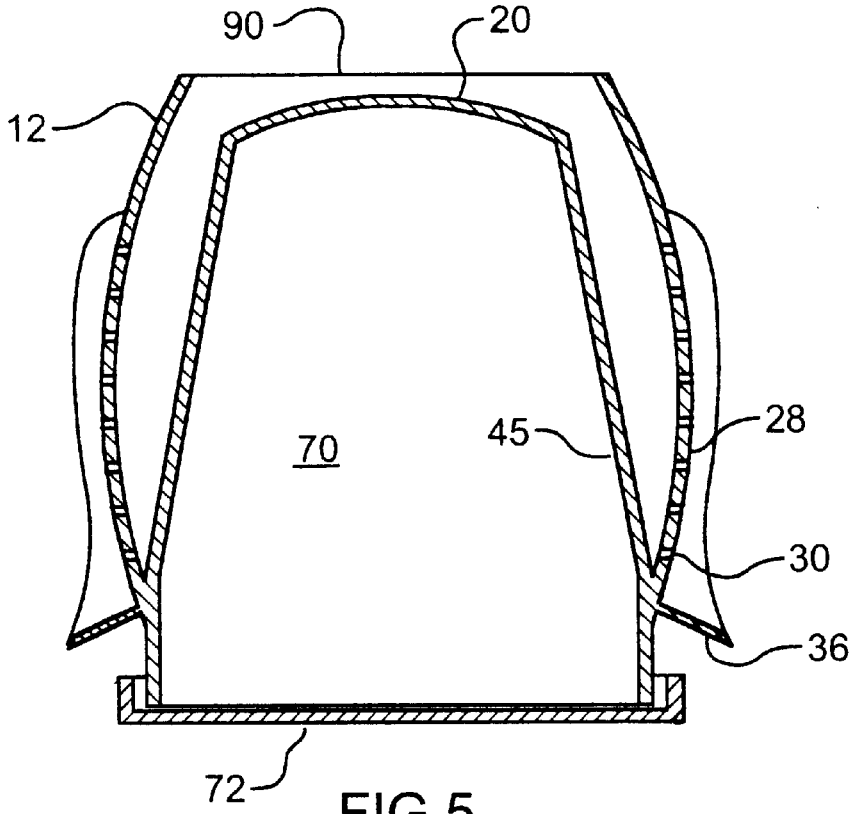
FIG. 5 is a cross-sectional side view of the game device of FIG. 4.

FIG. 5 shows in cross-section a first configuration of the reservoir 12 in FIG. 4 and which provides for a central displacement member 20 upstanding as an integral element of the reservoir 12, however, not beyond the upper edge 90 of the reservoir 12. An internal cavity 70 is defined within displacement member 20 can serve as a storage space for the other game components when the device is not in use and a removable snap-fitting cap 72 can also be provided to close the opening to storage cavity 70.

FIG. 5 shows the side walls 45 of the displacement member intersecting with the side walls 28 of the reservoir 12 immediately below the lowermost openings 30 in each array so that fluid in the reservoir 12 will effectively totally drain out of the reservoir. This can be advantageous when the device is to be used in a drinking game with, for example, a human consumable beverage as the liquid to be poured into the reservoir and the game played with a player to drink the liquid collected in his receptacle 14. Alcoholic beverages could be used with play proceeding with one or a plurality of different beverages or concentration of beverages being added as determined by the game rules.

Figure 6:
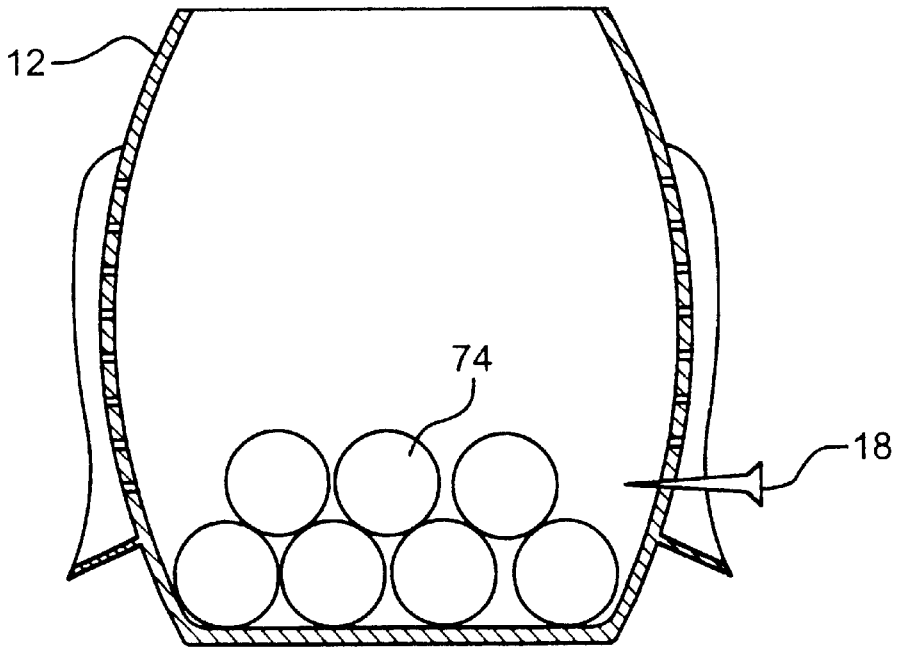
FIG. 6 is a cross-sectional side view of an alternate configuration of the game device of FIG. 4.

FIG. 6 shows in cross-section a second configuration of the reservoir shown in FIG. 4 without a fixed displacement member 20, however, in which separate displacement members 74 are provided as discrete members which can be placed into the reservoir 12 as a function of play. In one preferred arrangement, the members 74 may comprise golf balls and the pegs 18 golf tees. The game may be played by adding an amount of water to the reservoir initially and adding the balls 74 to raise the water level, for example, one ball 74 for each dot on a dice rolled. The game device could be sold without the golf balls and/or golf tees and the purchaser could use golf balls and tees or various displacement members as readily available, including rocks of various sizes and the like.

A reservoir 12 similar to that shown in FIGS. 4, 5 and 6 can be made inexpensively as by injection molding from plastic.

Figure 8:
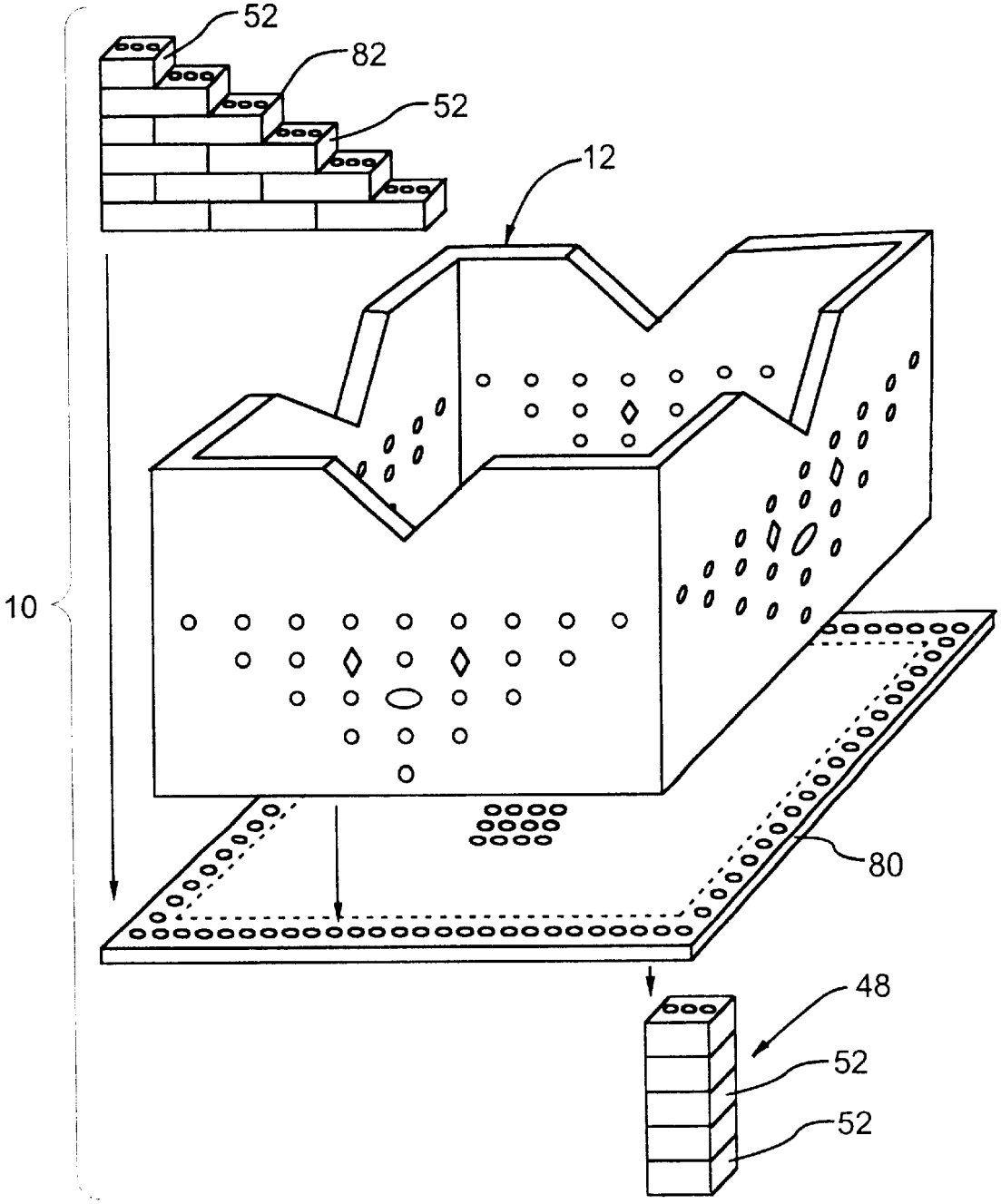
FIG. 8 is an exploded view of a game device similar to that of FIG. 7.

Reference is made to FIGS. 7 and 8 showing a third embodiment of the invention.

As seen in FIG. 7, the reservoir 12 is shown to be polygonal as a square. The reservoir 12 comprises four equally sized side walls 28 forming a closed container with the base. A footing 50 is provided secured to each side wall 28 and extending outwardly from the side wall 28, along each side wall 28 below the openings 30 of the arrays in each side wall.

The game device shown in FIG. 7 is adapted for use using as the blocking members, a plurality of modular building blocks of which only two are shown as 52 in FIG. 7. Such modular building blocks are known and sold, for example, under the trade mark LEGO. In a known manner, these blocks are adapted for securing to each other in successive rows and successive courses to form continuous wall structures. The building blocks lock together in a releasable friction snap-fit relationship accommodated by the resiliency of the materials forming the building blocks, typically, plastic and a specific configuration of the interlocking upper and lower faces of the building blocks. The footing 50 extends laterally from the wall and presents as its upper surfaces interlocking faces corresponding to those of the upper surfaces of the building blocks and, thus, permits the building blocks to be releasably secured thereto. The footing 50 thus, in effect, forms a base upon which a dam wall, formed of the building blocks 52, can be built upwardly adjacent the reservoir side wall 28.

In a preferred arrangement, the footing 50 can be configured such that, for example, a building block 52, when placed on the footing, will have an inwardly directed side surface of the building block 52 engage with the outwardly directed surface of the side wall 28 in a substantially sealed arrangement and thereby effectively prevent flow of water out of an opening 30 covered by the inwardly directed side surface of the building block. As seen in FIG. 7, each opening is adapted to be closed by the inwardly directed side surface of one block when placed in a wall formed on the footing 50 by a plurality of identical blocks 52. However, it is possible to also arrange building blocks such that the top-to-bottom engagement between building blocks and the end-to-end engagement between building blocks would provide a substantially water impermeable seal and, thus, the building blocks when built up in a wall above the footing 50 could provide, in effect, a dam wall preventing flow of water outwardly between the blocks. The footing 50 shown in FIG. 7 is a preferred arrangement in which the footing rises upwardly in a generally V shape following a general outline of the array of openings 30 and thereby reducing the number of building blocks which would be needed to provide a continuous height wall which closes all of the openings 30.

While it is preferred that each of the building blocks 52 be of identical size and shape, it is to be appreciated that building blocks could utilized which comprise multiple sizes of a basic size building block. For example, some double-sized building blocks could be provided. As well, the footing could be configured such that some rows have an odd number of places for modular building blocks and, therefore, both single and multiple building blocks would need to be used to form a complete row.

In the embodiment shown in FIG. 7, the openings 30 are of a number of different shapes and sizes. Having openings 30 of different sizes can vary the strategies which a player may need to develop to advantageously minimize water flow at varying levels of water in the reservoir. Rather than have each opening closed by one block 52, a number of blocks may be required as, for example, to close an uppermost V-shaped opening 53 at the top of each array which extends up to the upper edge 90 of the wall.

The reservoir shown in FIG. 7 is illustrated as elevated above a table surface by legs 48 a height sufficient that the collection receptacles 14, only one of which is shown, can be located underneath the side walls of the reservoir 12 and extend across substantially the complete width of the side of each side wall. Preferably, the footing 50 might be provided with a lower outer edge which extends downwardly and thereby reduces the likelihood of water flowing along the bottom undersurface of the base and otherwise not dropping downwardly into the receptacle 14 located therebelow.

While not shown in the drawings, a large-sized drain opening closed by a removable stopper could be provided which can be utilized to assist in draining the reservoir 12 as, for example, after playing a game.

FIG. 7 shows the footing 50 adapted to receive building blocks stacked in horizontal rows so as to build each successive row vertically upon the other row with each successive course to raise the elevation of the dam wall formed from the building blocks. The entire reservoir 12 and footing 50 may be manufactured as an integral, unitary member as, for example, out of plastic or out of a number of individual parts.

FIG. 8 shows in an exploded view, a configuration whereby the device of FIG. 7 is formed with a customized reservoir 12 having its own walls and base, adapted to be used with conventional pieces of a LEGO building block set. FIG. 8 shows a square planar LEGO type platform 80 which is adapted to have LEGO type building blocks secured to its upper and lower surfaces. While only shown about its perimeter and a small area of its interior, the platform 80 carries upper interlocking faces corresponding to those of the building blocks 52. The reservoir 12 preferably carries complementary interlocking faces on the bottom surface (not shown) of its base to those on the bottom of building blocks 52 such that the reservoir 12 is secured in a snap-fit to the upper surface of the platform 80. With the reservoir 12 on the platform 80, an outer periphery of the platform 80 is exposed to form the bottom of the footing 50 and on which additional building blocks 52 can be stacked as illustrated by one corner 82 formed of a plurality of individual blocks 52. Similarly, each leg 48 can be formed from individual blocks 52. Thus, with the present invention, it is to be appreciated that the reservoir 12, such as shown in FIG. 8, could be provided merely as an element adapted for interaction with a known building block set with the remainder including the entirety of the footing, the damming wall and legs to support the reservoir being provided by the building block members. A kit, therefore, for providing the game device might merely comprise the reservoir 12, the collection receptacles 14, a measuring cup and a chance determining mechanism such as a dice. The game device in accordance with the present invention thus could be provided as a relatively inexpensive accessory to a known building block set.

The collection receptacles 14 may have various mechanisms for indicating that the collection receptacles 14 have been filled to a desired level. For example, a mark or indicia could be placed on the inside surface of the receptacle 14 as in the manner of a mixing cup. Alternatively, the inside wall of the collection vessel may have a shoulder or step which would more visibly indicate when water has reached or been raised to a height higher than the step. An inner surface of the step could be raised compared to an outer surface such that once water raised up to the height of the step, a small pool would form on the step. As well, an opening could be provided through the wall of the collection receptacle 14 through which water would visibly pass when the collection receptacle 14 was full. Alternatively, the opening could extend through the wall in the receptacle 14 to a small internal pocket of the container which would readily be seen to be filled with water. Further, a ball-like float or other indicia could be provided within the collection receptacle 14 or a separate compartment of the collection receptacle in communication with the interior of the collection receptacle such that when the water reaches a certain level in the separate compartment, the ball or float indicia would visibly move upwardly. Further, a flag-like device could be pivotally mounted to the collection receptacle 14 with overflow water from the receptacle to be directed into a compartment in one end of the lever such that, on water overflowing from the collection receptacle, the one end of the lever would become heavier and this would raise the other end of the lever carrying the indicating flag. It is to be appreciated that many different mechanisms of different simplicity or complexity could be developed to provide an indicator as to when the water has flowed into the collection receptacle 14 in a sufficient volume to meet a desired requirement.

In use of the game in the preferred embodiment shown in FIG. 7 with building blocks, each player may be provided with building blocks of a different colour. As the building blocks may become relatively securely wedged against the wall 28 and to assist in their removal, a screwdriver-like or other lever mechanism may be provided as part of the game device for removal of the blocks.

In the context of a device as shown in FIG. 7, insofar as the building blocks may be utilized so as to form a dam wall which prevents flow of water between the blocks forming the dam, the footing could be arranged so as to have the wall formed by the blocks 52 spaced from the wall 12 and provide, in effect, a separate wall across a spillway for flow of water out of the reservoir to each receptacle. With this in mind, a game device could be developed having the appearance, for example, of a waterfall on each wall 28 with a spillway for flow of the water from the reservoir to each receptacle. Mounted in the spillway as in the manner of the footing may be various locations to receive building blocks to block the spillway in its entirety or, possibly, varying different flow channels within the spillway as, for example, simulating a river cord having a number of different passages.

The illustrated embodiments show the collection receptacles 14 as separate water containers. This is advantageous for retrieval and dumping of the water after use. However, it is to be appreciated that collection receptacles may be provided as part of an integral element forming, for example, the reservoir, the spillway and the collection receptacles.

The dice 24 is shown as one chance mechanism. Various other chance mechanisms could be provided such as a plurality of such dice, a number of specifically customized dice. The dice could be customized to indicate the number of blocks or pegs which can be applied or removed and/or indicate whether or not water is to be added via the measuring cup, to where the water is to be added and whether or not, for example, the valve permitting exit of water from the socket is to be opened or closed. Of course, other such chance elements such as spinners or a stack of cards or the like could provide for other manners of play such as missing a turn, skipping a turn, forced removal or application of plugs or blocks or the like.

The use of a chance mechanism is not necessary and play can be carried out without chance mechanisms as, for example, with each player permitted to carry out a set number of blocking member removals or additions or unit water additions per turn.

In another modification of the invention, the exterior surface of the side wall 28 could provide for removable coupling of blocking members thereto. For example, the exterior surface of the side wall 12, as shown in FIG. 8, could be provided with interlocking faces corresponding to the shape or configuration of either the top or bottom of the building block 52 and with blocks 52 to be inserted with its normally horizontally disposed top or bottom disposed vertically and engaging the exterior surface of the side wall 48 to removably fasten a building block to the wall in a friction-lock arrangement and thereby substantially sealing any opening 30 covered by the building block.

Figure 9:
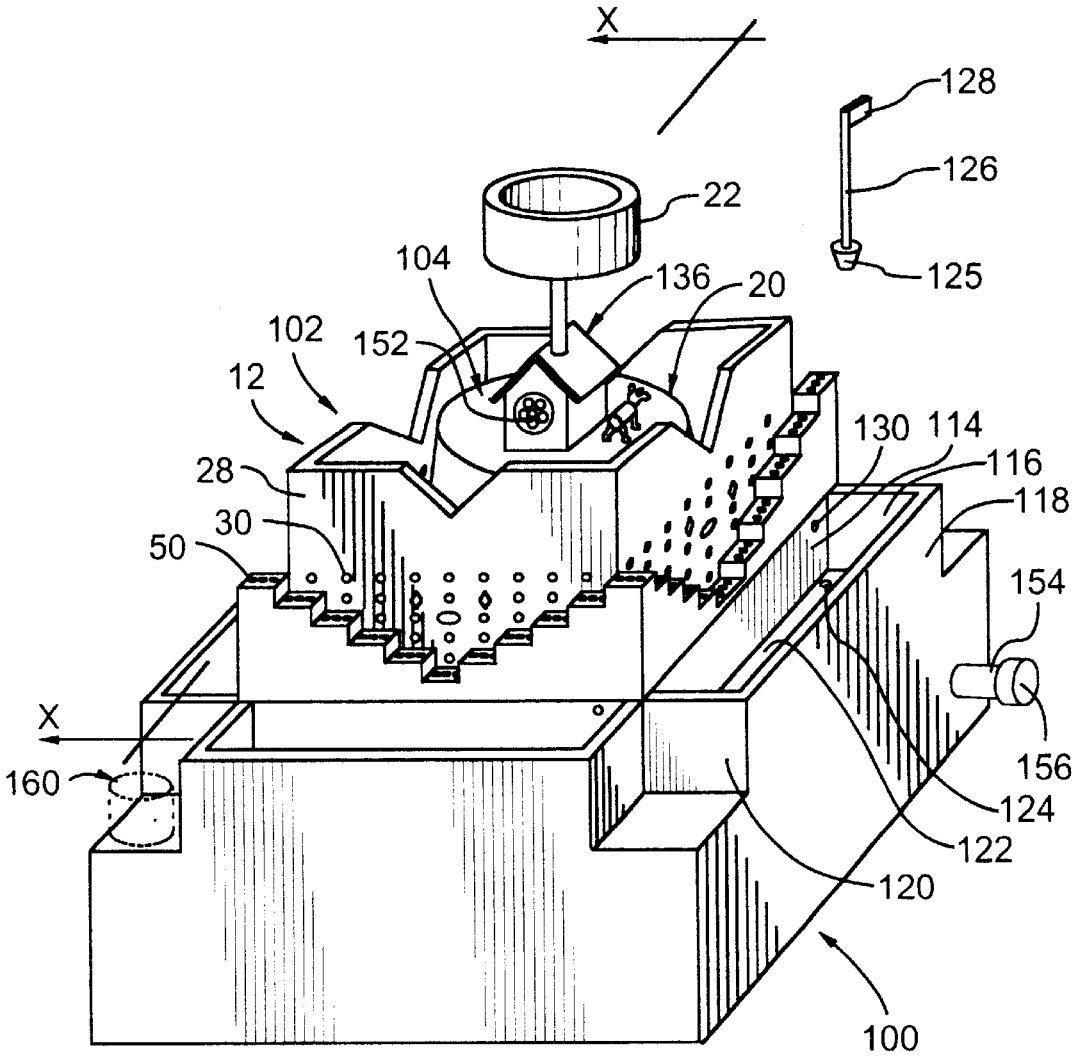
FIG. 9 is a pictorial view of a fourth embodiment of a game device in accordance with the present invention.
Figure 10:
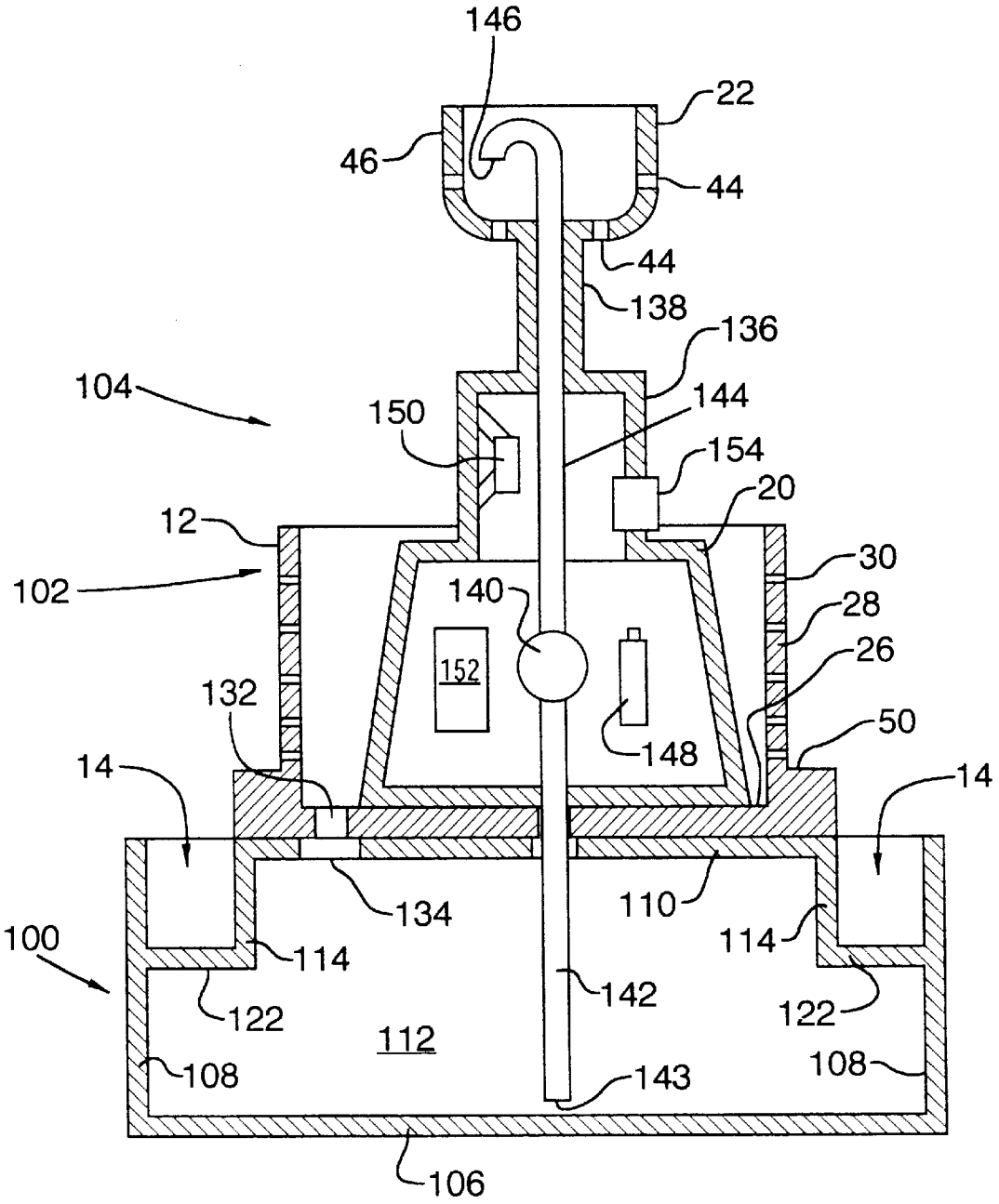
FIG. 10 is a cross-sectional view along line X—X' in FIG. 9.

Reference is made to FIG. 9 and 10 which show a fourth embodiment of the present invention. As seen in FIG. 10 which is a cross-sectional view along line X—X' in FIG. 9, the game device may be described as comprising three major components, namely a base member 100, a reservoir member 102 and a tower member 104. The base member 100 has a bottom 106, side walls 108 and a top wall 110 which define a water retaining compartment 112 internally within the base member 100. The base member 100 also defines on each of its four sides four collection receptacles 14 defined by respective wall portions 114, 116, 118 and 120 and floor 122, such that each compartment 14 is an internal part of the base member. As seen in FIG. 9, each collection receptacle 14 has a drain opening 124 through floor 122 opening into the compartment 112 which can be closed by a fiction-fit stopper 125, only one of which is shown in FIG. 9, carried on a rod 126 having an identifying flag 128. The flag 128 may have different indicia or colour identifying the four individual player stations. Each collection receptacle 14 also has an overflow outlet 130 through wall portion 114 opening into the compartment 112 so that once any collection receptacle 14 may become filled with water to the level of outlet 130 additional water will flow into the compartment 112.

The reservoir member 102 is substantially the same as the third embodiment of the present invention shown in FIG. 7.

Reservoir member 102 has a reservoir 12 with a base 26 and upstanding walls 28 with openings 30 therethrough. Footing 50 is adapted to have modular building blocks stacked therein to block the openings 30. The base 26 has a drain opening 132 therethrough which is to be closed by a removable stopper similar to the friction-fit stopper 125 shown in FIG. 9 to close a drain opening 124 in the collection receptacle 14. Drain opening 132 though base 26 of the reservoir 12 is in communication with an inlet opening 134 through top wall 110 into compartment 112 so that water in the reservoir 12 may be drained into the compartment 112.

The tower member 104 is illustrated as a displacement member 20 of frustonconical shape, carrying a representation of a house 136 therein. A representation of four-legged animal 137 is also provided, however, another article, living entity, plant, humanoid or the like could be provided. A tubular support 138 extends upwardly from the house 136 and supports a delay vessel 22 thereabove.

As is the case with the delay vessel 22 shown in the other embodiments, the delay vessel 22 has holes 44 in its walls 46 out of which water in the delay vessel is to flow, dropping about the house 136 to mimic rainfall.

The tower member 104 is schematically shown as a hollow member which carries protected within its interior a pump 140 to pump water from the compartment 112 into the delay vessel 22 by means of a hollow inlet tube 142 which extends from its inlet 143 in the compartment 112 to the pump and a hollow outlet tube 144 which extends from the pump internally through the house 136 and tubular support 138 into the delay vessel 22 to an outlet 146 in the delay vessel 22.

The tower member 104 is shown to schematically provide a power source for the pump 140, indicated as a symbol representing an electric battery 148 which is to be operatively connected to the pump 140.

The house 136 is schematically shown as carrying a loud speaker 150 for broadcast of sound through a water proof speaker port 152 in the side wall of the house 136. A control mechanism 152 is schematically shown inside the tower member 104 as useful to play sounds, such as rain, waterflow, wind and/or thunderstorm sounds through the loudspeaker as when the pump 140 is operative. A waterproof manual on/off switch 154 is schematically shown in an end wall of the house 136 in FIG. 10 which is operative, for example, as via the control mechanism is 152 and/or battery 148 to switch the pump 140 on and off and to play sounds.

The outlet tube 144 passes through the wall of the delay vessel 22 in a sealed relation so that water does not enter the tower member 104. The inlet tube 142 extends through aligned openings through a floor of the tower member 104, through the base 26 of the reservoir 12 and the top wall 110 of the base member 100, preferably with the inlet tube 142 being easily removed with tower member 104 from the reservoir member 102.

While not necessary, as shown the tower member 104 may be removed from the reservoir member 102 and the reservoir member 102 may be removed from the base member 100.

The compartment 112 of the base member 100 preferably can hold sufficient water for a complete game and is filled with sufficient water for a complete game by adding water via its inlet opening 134 either directly or by placing water into the reservoir 12 with the drain opening 132 open.

With the compartment 112 carrying sufficient water, with the drain opening 132 in reservoir 12 closed, and the drain openings 124 of the each collection receptacle 14 closed, play may commence by moving the switch 154 a position which activates the pump 140 to pump water into the delay vessel 22 from which water will drop automatically into the reservoir 12 and hence from the reservoir 12 into the respective collection receptacle 14. The pump 140 may pump water continuously until the end of the game. When any collection reservoir 14 is filled to the level of overflow outlet 130 excess water will flow back into the compartment 112. After play is complete, the pump 140 may be stopped and thereafter by opening drain openings 124 and 132 all water will drain back into compartment 112.

As seen in FIG. 9, a separate exit spout 154 closed by a threaded cap 156 may be provided to assist in dumping water from the base member 100.

The loudspeakers 150 may be controlled by the control mechanism in a simple way to merely play sounds while the pump is operative. Alternatively, sounds may be selected to give instructions or comments on play such as who is play first, to advise of time remaining, and to announce change or random matters such as that a player of a given colour is to miss a turn and the like. The sound may be synchronized with the pump operation.

The control mechanism may operate the pump continuously at all times during play, or cycle the pump on or off during play or operate the pump at variable flow rates, all as determined by the different play sequences as may be programmed or determined or controlled by the users.

Rather than merely have an on/of button, a control button may be provided to select modes of operation. Inputs to the control mechanism could permit a user to input commands during play to control pump operation.

A mechanism for indication that a collection receptacle has been filled to a desired level could provide a signal to the control mechanism as to stop the pump and/or cause a sound over the loud speaker as in the manner of an alarm and/or to activate a signal light. A simple switch which closes via the presence of water in overflow outlet 130 could be used.

A preferred pump 140 is operated by a low wattage electric motor driven by 6 to 9 volt batteries wherein can be replaceable or rechargeable. The motor could be safely connected to a protected AC power source as with a low wattage transformer.

The pump 140 could be a wind-up spring powered motor which could be manually wound from time to time.

Rather than have a pump, the outlet tube 144 could be connected to a source of water, for example outlet tube 144 could be connected to a pressured hose of water from a domestic water source and the water flow controlled by a valve. An electrically opened solenoid valve could replace the pump 140 to permit control of water flow by the control mechanism.

An inflatable elastic bladder could be provided in the compartment 112, filled with water and pressured by water pressure or by manually pumping air into the bladder. The elasticity of the bladder and/or air pressure could then deliver water out the outlet 146.

Rather than provide an electric pump inside the tower member 100, a manually operated hand pump could be provided externally and be adapted to be activated as the squeezing by a player to pump water from the compartment 112 into reservoir 12. For example, a manual pump could be produced on the base member 100 at each outer corner of the base member 100, as shown on a cylindrical button member 160 in dashed lines in FIG. 9 with each of four pumps connected to a tube to extend from the compartment 112 internally upward to the delay vessel 22.

The embodiment of FIG. 9 and 10 shows the game device formed from three elements. The entire assembly would be an integral element and/or be provided divisible into elements other than the three shown. Any batteries may be in a separately sealed compartment. The pump 140, power supply, control and switches may be provided in compartment 112. The loudspeaker 150 may be provided at various locations. Preferably the base member 100 is provided below the reservoir member 102 and supports the reservoir member vertically above the base member.

Various elements of the embodiments of FIGS. 9 and 10 may be adopted for use without other of the elements, for example with the reservoir member 102 useful separately as shown in FIG. 7 or with other elements as shown in FIG. 9.

The embodiments of FIG. 9 and 10 simulate rainfall by having the delay vessel 22 receive water and permit water to drop automatically out of holes in simulation of a rain cloud. Rather then have a delay vessel 22, the outlet tube 144 may itself directly dispense water into a fine spray such as through a shower nozzle with outlets directly downward concentrically about the tubular support 138. This could be used not only with a pump 140 but also when connecting the outlet tube 144 directly to a pressured water hose.

The extent water is to be contained in the game device and controlled against spillage will largely depend on whether the device in designed for use in a pool, tub or water table or outdoors where water spillage is not disadvantages and whether the device is designed for indoor use without water spillage as on a dry table.

While the invention has been described with reference to preferred embodiments, many modifications and variations will now occur to persons skilled in the art. For a definition of the invention, reference is made to the appended claims.

We claim:

1. A game device comprising:

a water reservoir, a plurality of openings for exit of water from the reservoir, each opening having at least one blocking member adapted to either block flow of water from the opening or permit flow of water from the openings, the openings comprise a plurality of arrays of openings the openings of each array corresponding in number, size and elevation, a collection receptacle for each array for collecting all water exiting the openings of its respective array of openings, each collection receptacle having an overflow outlet from which water flows from the collection receptacle when water in the collection receptacle reaches the height of the overflow outlet, a water storage vessel disposed at a height below the overflow outlet for receiving water flowing from the overflow outlet.

2. A game device as claimed in claim 1 wherein each collection receptacle has a closable drain outlet for gravity draining the receptacle, the storage vessel disposed at an height below the drain outlet for receiving water drained from the receptacle via the drain outlet.

3. A game device as claimed in claim 2 wherein the reservoir has a closable drain outlet for gravity draining of the reservoir, the storage vessel disposed at a height below the drain outlet for receiving water drained from the receptacle via the drain outlet.

4. A device as claimed in claim 1 wherein a pump mechanism is provided to pump water from the storage vessel to the reservoir.

5. A device as claimed in claim 4 wherein the pump mechanism comprises a pump operated by an electric meter, a battery power source is provided for powering the electric motor, the pump and battery power source concealed within the game device, a switch mechanism is provided to activate the motor.

6. A device as claimed in claim 5 including a control mechanism to control the operation of the pump mechanism over time, the control mechanism being programmable to provide a plurality of selectable and/or controllable routines of operation over time.

7. A game device as claimed in claim 1 including an outlet which dispenses water at a height above the reservoir so that water dispensed from the outlet flows into the reservoir.

8. A game device as claimed in claim 7 wherein the outlet has a plurality of small openings and the water dispenses from the outlet above the reservoir from the small openings.

9. A game device as claimed in claim 1 including a sound broadcasting device for broadcast of sounds selected from sounds of rain, flowing water, wind and thunder.

10. A game device as claimed in claim 8 wherein a representation of a building and/or living entities is provided supported above or within the reservoir below the outlet and upon which water dispensed from the outlet falls in flowing into the reservoir.

11. A game device as claimed in claim 8 including a sound broadcasting mechanism for broadcast of sounds.

12. A game device as claimed in claim 11 wherein the sound includes sounds selected from sounds of rain, flowing water, wind and thunder.

13. A game device as claimed in claim 7 wherein the outlet is connected to a source of pressurized water.

14. A game device as claimed in claim 13 including a mechanism to control flow of water from the source.

15. A method of playing a game with a game device comprising a water reservoir, a plurality of openings for exit of water from the reservoir, and a plurality of blocking members, each blocking member adapted to be movable between positions in which it either blocks flow of water from at least one opening or permits flow of water from the reservoir through at least one opening and the openings being divided into a plurality of arrays of openings each directing water which flows from the opening into a corresponding collection receptacle, one array of openings and collecting receptacle being provided for each player, the method comprising placing water in the reservoir by dispensing water from an outlet to fall into the reservoir with the blocking member for each array in a predetermined configuration, permitting each player to move one or more blocking members between the blocking and unblocking positions while monitoring the water collected in each respective collection receptacle.

16. A method as claimed in claim 15 wherein water is dispensed continuously from the outlet.

17. A method as claimed in claim 15 including:

broadcasting sounds when water is dispensed selected from sounds of rain, flowing water, wind and thunder.

18. A method as claimed in claim 15 wherein each player can control a pump mechanism activatable to pump water from the outlet.

19. A method as claimed in claim 15 wherein a signal is provided when a collection receptacle is filled with water to a predetermined level.

* * * * *